US010557653B1

(12) United States Patent
Buschur

(10) Patent No.: US 10,557,653 B1
(45) Date of Patent: Feb. 11, 2020

(54) SUCTION STABILIZER CONTROL CIRCUIT FOR A HEAT PUMP SYSTEM

(71) Applicant: Jerome Buschur, St. Henry, OH (US)

(72) Inventor: Jerome Buschur, St. Henry, OH (US)

( * ) Notice: Subject to any disclaimer, the term of this patent is extended or adjusted under 35 U.S.C. 154(b) by 0 days.

(21) Appl. No.: 16/254,519

(22) Filed: Jan. 22, 2019

Related U.S. Application Data

(60) Provisional application No. 62/619,985, filed on Jan. 22, 2018.

(51) Int. Cl.
*F25B 40/06* (2006.01)

(52) U.S. Cl.
CPC ..... *F25B 40/06* (2013.01); *F25B 2341/064* (2013.01); *F25B 2400/0411* (2013.01); *F25B 2700/1933* (2013.01)

(58) Field of Classification Search
CPC ..... F25B 40/06; F25B 2341/064; F25B 2400/0411; F25B 2700/1933
See application file for complete search history.

(56) References Cited

U.S. PATENT DOCUMENTS 3,791,160 A * 2/1974 Savitz ..... F24F 3/1405 62/196.4
4,645,908 A * 2/1987 Jones ..... F24D 11/0214 392/340
5,247,989 A * 9/1993 Benevelli ..... B60H 1/00007 165/263
2009/0095442 A1* 4/2009 Wiggs ..... F25B 30/06 165/45
2016/0209100 A1* 7/2016 Jentzsch ..... F25B 47/025

* cited by examiner

*Primary Examiner* — David J Teitelbaum
(74) *Attorney, Agent, or Firm* — Allen Dyer Doppelt & Gilchrist

(57) ABSTRACT

In a heat pump system, a suction stabilizer control circuit (SSCC) reduces or eliminates subcooling at the condenser and reduces superheating needed for compressor protection at the evaporator. The SSCC includes a bypass line that bypasses a predetermined portion of flow through a refrigerant liquid transport line around a thermostatic expansion valve (TXV).

19 Claims, 3 Drawing Sheets

SUCTION STABILIZER CONTROL CIRCUIT FOR A HEAT PUMP SYSTEM

CROSS-REFERENCE TO RELATED APPLICATION

This application claims the benefit of U.S. Provisional Patent Application Ser. No. 62/619,985, filed on Jan. 22, 2018, the contents of which are herein incorporated by reference in their entirety.

FIELD OF THE INVENTION

The present invention relates to heat pump systems, and more particularly, to apparatus and method for regulating suction pressure between the evaporator and the compressor.

BACKGROUND OF THE INVENTION

The basic structure and function of heat pump systems is well understood. Generally, a first heat exchanger is arranged in a unit to be heated and cooled (e.g., a home or other building, etc.) and a second heat exchanger is arranged to communicate with a heat source/sink (e.g., outside air, geoexchange medium, etc.). With a flow direction depending on operational mode (i.e., heating or cooling) a compressor is arranged in a vapor refrigerant transport line between the heat exchangers and one or more thermostatic expansion valves (TXVs) are arranged in a liquid refrigerant transport line. Again depending on operational mode, one of the two heat exchangers is an evaporator and the other is a condenser (e.g., in heating mode, the first heat exchanger is the condenser and the second is the evaporator).

Referring to FIG. 1, a simplified, typical heat pump system 110 includes an evaporator 112, a condenser 114, a compressor 116 and a thermal expansion valve (TXV) 120. A refrigerant vapor transport line 122 extends between an evaporator outlet 124 and a condenser inlet 126 through the compressor 116. A refrigerant liquid transport line 130 extends between a condenser outlet 132 and an evaporator inlet 134 through the TXV 120.

The compressor 116 receives vapor refrigerant from the evaporator outlet 124 at a compressor inlet 136, compresses the vapor refrigerant and fees to the compressed vapor refrigerant from a compressor outlet 140 to the condenser inlet 126. If the refrigerant is not completely vaporized in the evaporator 112, liquid refrigerant remaining entrained in the vapor exiting the evaporator outlet 124 can seriously damage the compressor 116.

The TXV 120 is used to prevent liquid refrigerant from leaving the evaporator outlet 124. The TXV 120 includes a valve body 142 defining a valve flow path 144 extending between a TXV inlet 146 and a TXV outlet 150. A head portion 152 of the TXV has a sensing connection 154 and an equalization connection 156.

The sensing connection 154 is connected to a sensing line 160, typically in the form of a capillary tube 162 having a distal end terminating a sensing bulb 164 which is in thermal contact with the refrigerant vapor transport line 122 proximate the evaporator outlet 124. The sensing line 160 is filled with a sensing line refrigerant, more or less of which will vaporize depending on the amount of refrigerant superheat present at the evaporator outlet 124. More superheat results more sensing line refrigerant vaporized and more pressure delivered to the head portion via the sensing connection 154.

A diaphragm 166 is located in the head portion 152. One side of the diaphragm 166 is exposed to pressure from the sensing connection 154 and the other side is exposed to pressure from an equalization connection 156 which is directly connected to the refrigerant vapor transport line 122 downstream of the evaporator outlet 124 via an equalization line 170. On smaller systems, an internal equalization connection and line 156A, 170A can be used.

A throttling element 172 extends into the valve flow path 144 is movable by connection with the diaphragm 166 variably restrict refrigerant flow passing from the TXV inlet 146 to the TXV outlet 150. With greater pressure at the sensing connection 154, the throttling element 172 will move to restrict refrigerant flow less and vice versa.

A biasing element 174, such as a spring, exerts force on the throttling element 172 opposite that of the pressure from the sensing connection 154. By adjusting the biasing force exerted by the element 174, the response of the TXV 120 can be adjusted.

As noted above, significant operational concern in heat pump systems is protecting the compressor from impingement by liquid refrigerant. This is prevented by configuring the system, typically via setting of the TXV, to ensure that the refrigerant leaving the condenser is sufficiently superheated to preclude the possibility of liquid refrigerant ever reaching the compressor. This will often translate into ensuring at least 10 to 20 degrees of Fahrenheit superheat at the outlet of the evaporator. While this will suffice to protect the compressor, the system will suffer efficiency losses as a result.

SUMMARY OF THE INVENTION

In view of the foregoing, it is an object of the present invention to provide a suction stabilizer control circuit for heat pump systems. In particular, it is an object of the present invention to provide a suction stabilizer control circuit that reduces or eliminates subcooling at the condenser and reduces superheating needed for compressor protection at the evaporator.

According to an embodiment of the present invention, a suction stabilizer control circuit (SSCC) for a heat pump system comprises a thermostatic expansion valve (TXV), TXV inlet and outlet lines, and a TXV bypass line.

The TXV includes a valve body, a throttling element, a diaphragm and a biasing element. The valve body defines a valve flow path extending between a TXV inlet and TXV outlet, and includes a TXV head portion having a sensing connection and an equalization connection. The throttling element extends into the valve flow path and is movable to variably restrict refrigerant flow passing from the TXV inlet to the TXV outlet. The diaphragm is positioned in the TXV head portion and connects to the throttling element such that increased pressure from the sensing connection will urge the throttling element to increase refrigerant flow restriction. The biasing element is arranged in the valve body and is operable to urge the throttling element to decrease refrigerant flow restriction.

The TXV inlet and outlet lines extend from the TXV inlet and the TXV outlet, respectively. The TXV bypass line has a bypass inlet and a bypass outlet connected to the TXV inlet line and TXV outlet line, respectively, such that a predetermined portion of refrigerant flow passing between the TXV inlet and outlet lines passes through the TXV bypass line.

According to another embodiment of the present invention, a heat pump system comprises an evaporator having an evaporator inlet and outlet, a condenser having a condenser inlet and outlet, a refrigerant vapor transport line extending between the evaporator outlet and the condenser inlet, a compressor arranged in the refrigerant vapor transport line between a compressor inlet and outlet and operable to compress the refrigerant vapor passing therethrough, a refrigerant liquid transport line extending between the condenser outlet and the evaporator inlet. The SSCC is arranged in the refrigerant liquid transport line, and a sensing line extends from the sensing connection to a distal end in thermal contact with the refrigerant vapor transport line proximate the evaporator outlet.

According to a method aspect, a method of reducing condenser subcooling and evaporator superheating in a heat pump system comprises passing refrigerant flow from the condenser outlet to the suction SSCC, dividing the refrigerant flow in the SSCC into first and second portions, directing the first portion of the refrigerant flow in the SSCC to the TXV, variably throttling the first portion of the refrigerant flow in the TXV based on sensed superheating at an evaporator outlet, directing the second portion of the refrigerant flow in the SSCC to the bypass line bypassing the TXV, combining the first and second portions of the refrigerant flow downstream of the TXV, and supplying the combined refrigerant flow to an evaporator inlet.

These and other objects, aspects and advantages of the present invention will be better appreciated in view of the drawings and following detailed description of preferred embodiments.

DETAILED DESCRIPTION OF PREFERRED EMBODIMENTS

Figure 1:
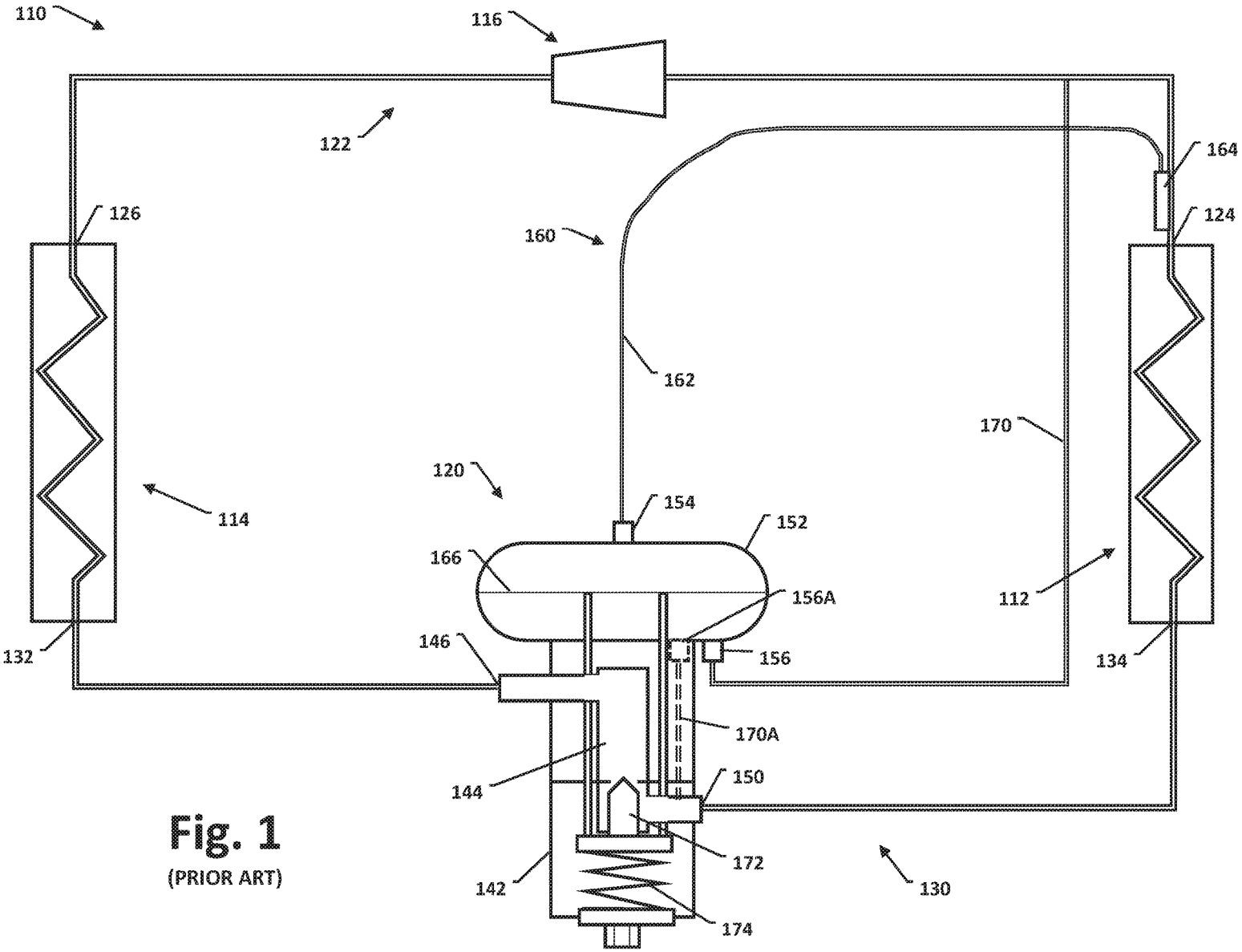
Fig. 1 (PRIOR ART)
FIG. 1 is a schematic view of a simplified heat pump system.
Figure 2:
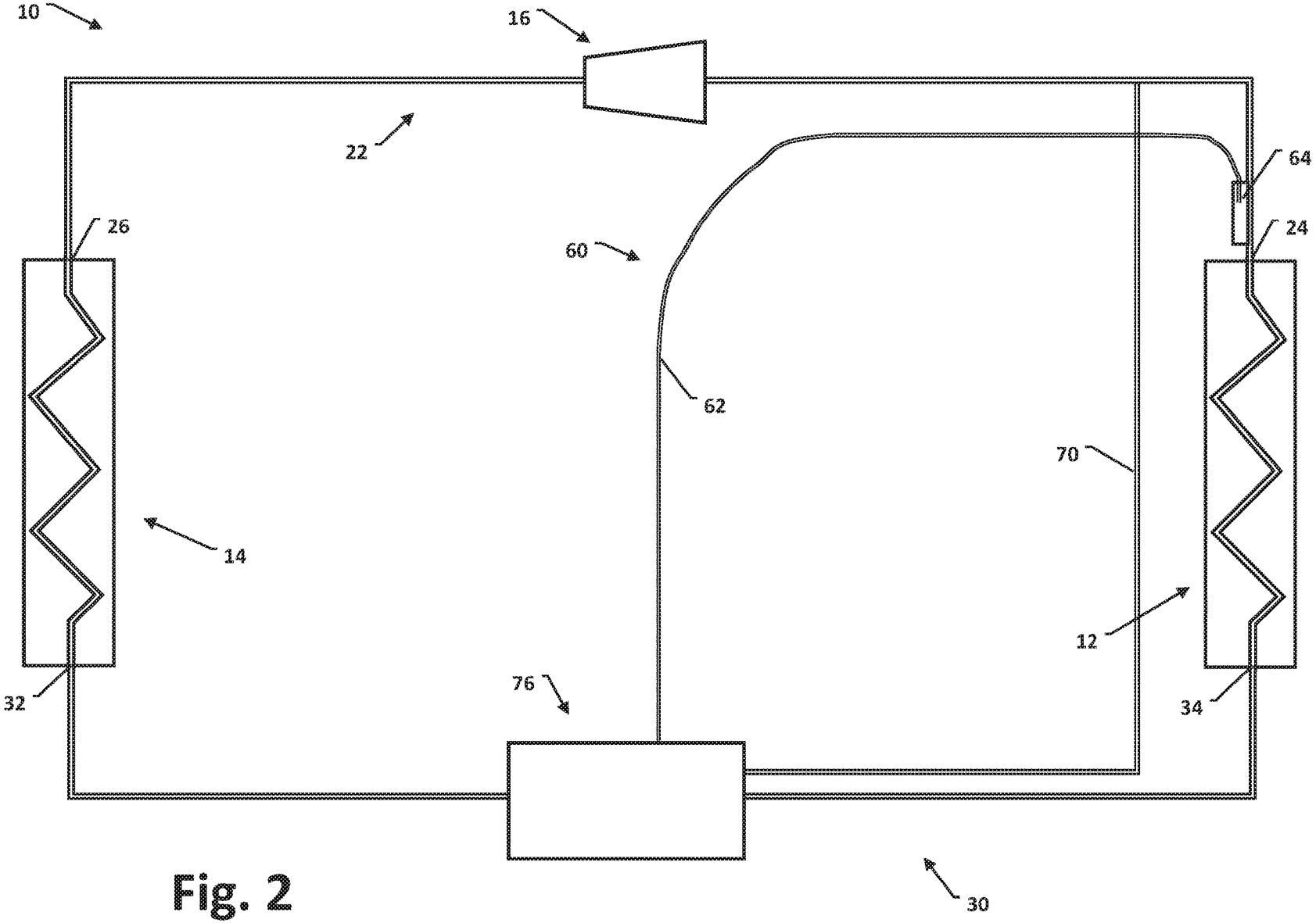
FIG. 2 is a schematic view of a heat pump system including a suction stabilizer control circuit (SSCC), according to an embodiment of the present invention.
Figure 3:
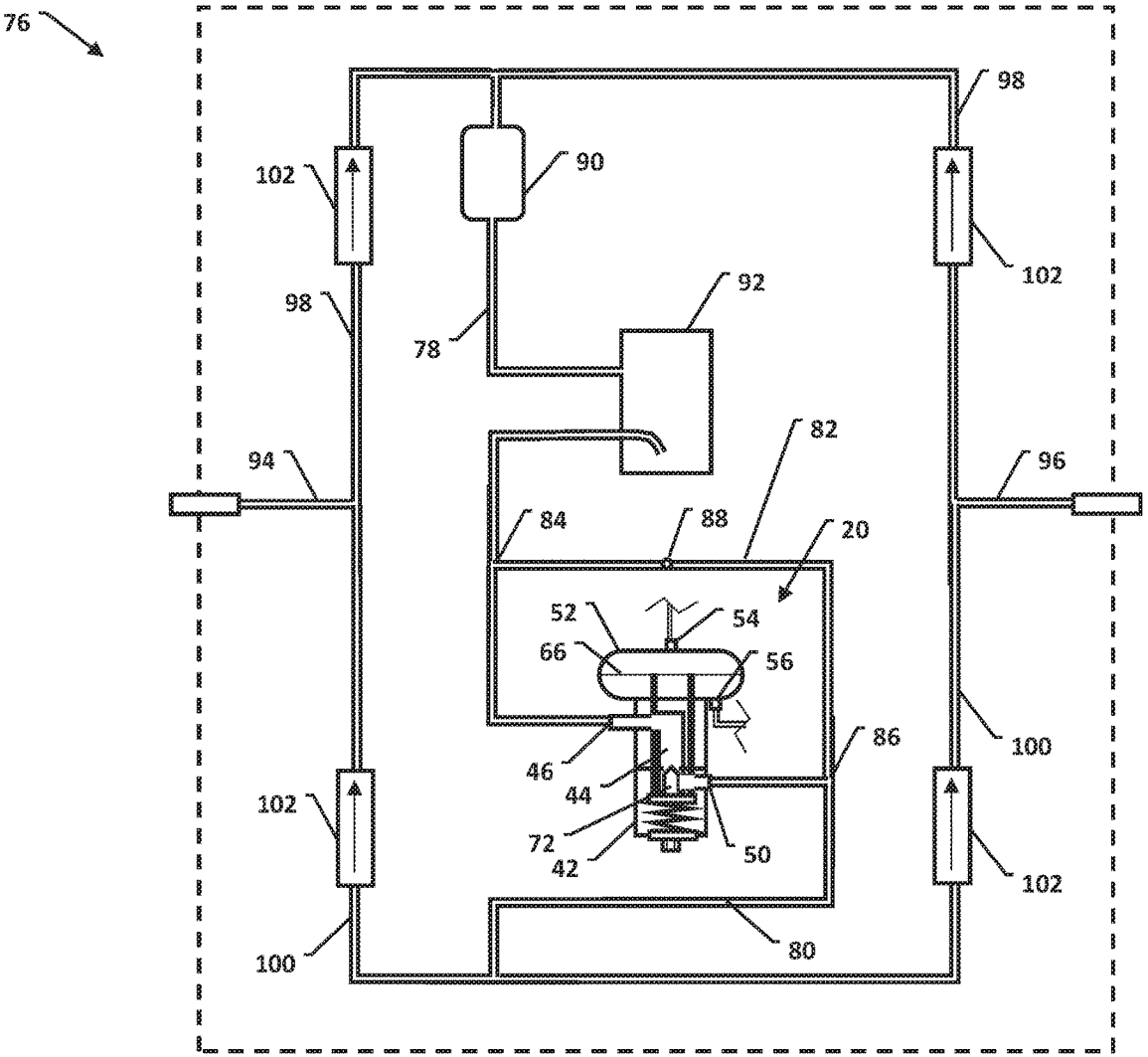
FIG. 3 is a schematic view of the SSCC of FIG. 2.

Referring to FIGS. 2 and 3, a heat pump system 10 includes a suction stabilizer control circuit (SSCC) 76, according to an embodiment of the present invention. With differences described below relating to the SSCC 76, the heat pump system 10 includes the same basic components as the heat pump system 110 and corresponding components are labeled with the same reference numbers without the preceding "1" (e.g., compressor 116 and compressor 16, evaporator 112 and evaporator 12). Components labeled in this manner but not specifically mentioned in FIGS. 2 and 3 should be understood as referring to the earlier described corresponding components.

The SSCC 76 is arranged in the refrigerant liquid transport line 30 between the condenser outlet 32 and the evaporator inlet 34. Within the SSCC, the thermostatic expansion valve (TXV) 20 is connected between a TXV inlet line 78 leading to the TXV inlet 46 and a TXV outlet line 80 leading from the TXV outlet 50. A metered TXV bypass line 82 extends between a bypass inlet 84 and bypass outlet 86 connected to the TXV inlet and outlet lines 78, 80, respectively. A flow restricting orifice 88 is arranged in the bypass line 82.

The TXV bypass line 82 allows a predetermined portion of the refrigerant flow to be divided from the portion sent through the valve flow path 44 of the TXV 20 and subject to restriction by the throttling element 72. This predetermined portion recombines with the restricted portion and together constitutes the liquid refrigerant flow supplied from the SSCC 76 to the evaporator inlet 34.

The use of the bypass line 82 allows additional liquid refrigerant to be supplied to reduce superheating at the outlet of the evaporator/subcooling at the condenser via a different means that simply adjusting the TXV setting. The dimensioning of the orifice 88 allows determination of the amount of bypass flow. This determination is advantageously made based on system 10 load requirements.

Advantageously, both a filter dryer 90 and a liquid receiver 92 are arranged in the TXV inlet line 78 upstream of the bypass inlet 84. Liquid refrigerant consequently passes through the filter dryer 90 and then the liquid receiver 92 before entering either the TXV 20 or the bypass line 82.

The present invention is not limited to use with a particular type of refrigerant or lubricating oil. However, in one preferred embodiment, the compressor 16 is configured for use with chlorofluorocarbon (CFC) or hydrochlorofluorocarbon (HCFC) refrigerants, and an optimal polyolester (POE) lubricating oil is used in conjunction therewith.

In the interests of simplicity, the two heat exchangers of the heat pump system 10 are identified as the evaporator 12 and the condenser 14. In one preferred embodiment, one heat exchanger is an indoor air handler for a heating, ventilation and air conditioning (HVAC) system and the other heat exchanger is an earth loop of a geoexchange system. Nothing prevents an SSCC according to the present invention from being used in a two-way heat pump system in which a reversing valve or similar means is used to reverse the direction of refrigerant flow depending on whether the conditioned space is to be heated or cooled.

For use in a two-way system, the SSCC 76 includes first and second side connection lines 94, 96 which connect in the refrigerant liquid transport line 30 between the heat exchangers. Each of the connection lines 94, 96 has respective inlet and outlet lines 98, 100 branching therefrom. Each inlet line 98 extends between its respective connection line 94, 96 and the TXV inlet line 78 at a point upstream of the bypass inlet 84 (and the filter dryer 90 and receiver 92). Each outlet line 100 extends from its respective connection 94, 96 and the TXV outlet line 80 at a point downstream of the bypass outlet 86.

A check valve 102 is arranged in each of the inlet and outlet lines 98, 100 (permitted flow direction indicated by arrows in FIG. 3). With refrigerant flow proceeding from the first side connection line 94, the check valve 102 in the first side outlet line 100 ensures refrigerant cannot flow directly to the TXV outlet line 80 while the check valve 102 in the second side inlet line 98 ensures that refrigerant flow cannot circumvent the TXV inlet line 78 and pass directly to the second side connection line 96. With the direction of refrigerant flow reversed, the check valve 102 in the second side outlet line 100 ensures refrigerant cannot flow directly to the TXV outlet line 80 while the check valve 102 in the first side inlet line 98 ensures that refrigerant flow cannot circumvent the TXV inlet line 78 and pass directly to the first side connection line 94.

Referring to FIG. 2, the suction stabilizer circuit surrounds a thermostatic expansion valve (TXV) including a head portion and defining a valve flow path between a TXV inlet and outlet, the TXV further including a throttling element disposed in the valve flow path and configured to regulate fluid flow through the valve flow path, wherein the throttling element is further configured to have a position that is responsive to a pressure and temperature level in the head portion. A pressure sensing line fluidly communicates between the vapor refrigerant transport line and the head portion of the expansion valve and a thermal sensor responding to the temperature of the vapor transport line. The suction stabilizer circuit includes a filter/dryer and a refrigerant receiver upstream of the TXV inlet and a metered bypass line around the TXV.

The metered bypass line is configured to pass a predetermined portion of refrigerant passing through the heat pump system, such that the total refrigerant flow through the liquid refrigerant transport line equals the bypass line flow plus the flow supplied by the TXV based on sensed pressure and temperature. The predetermined portion of refrigerant is advantageously determined based on load requirements. In one embodiment, the compressor is a refrigerant compressor configured for use with CFC or HCFC refrigerants and an optimal polyolester (POE) lubricating oil is used in conjunction therewith.

A SSCC according to the present invention advantageously eliminates subcooling at the condenser and reduces superheating at the evaporator (advantageously as low as 4 degrees Fahrenheit), which increases condenser activity, system capacity and efficiency, while stabilizing suction pressure regardless of discharge pressure and continuing to ensure protection of the compressor from liquid refrigerant.

The foregoing is provided for illustrative and exemplary purposes; the present invention is not necessarily limited thereto. Rather, those skilled in the art will appreciate that various modifications, as well as adaptations to particular circumstances, are possible within the scope of the invention as herein shown and described and of the claims appended hereto.

What is claimed is:

1. A suction stabilizer control circuit (SSCC) for a heat pump system, the SSCC comprising:

a thermostatic expansion valve (TXV) including a valve body defining a valve flow path extending between a TXV inlet and TXV outlet, the valve body including a TXV head portion having a sensing connection and an equalization connection;

a throttling element extending into the valve flow path and movable to variably restrict refrigerant flow passing from the TXV inlet to the TXV outlet;

a diaphragm positioned in the TXV head portion and connected to the throttling element such that increased pressure from the sensing connection will urge the throttling element to increase refrigerant flow restriction; and a biasing element arranged in the valve body operable to urge the throttling element to decrease refrigerant flow restriction;

TXV inlet and outlet lines extending from the TXV inlet and the TXV outlet, respectively;

a TXV bypass line having a bypass inlet and a bypass outlet connected to the TXV inlet line and TXV outlet line, respectively, such that a predetermined portion of refrigerant flow passing between the TXV inlet and outlet lines passes through the TXV bypass line;

first and second side connection lines for connecting in a liquid refrigerant transport line between heat exchangers of the heat pump system;

first side inlet and outlet lines branching from the first side connection line and connected with the TXV inlet line and TXV outlet line, respectively;

first side inlet and outlet check valves arranged in the first side inlet and outlet lines, respectively, the first side inlet check valve oriented to block flow from the TXV inlet line toward the first side connection line, the first side outlet check valve oriented to block flow from the first side connection line toward the TXV outlet line; and second side inlet and outlet check valves arranged in the second side inlet and outlet lines, respectively, the second side inlet check valve oriented to block flow from the TXV inlet line toward the second side connection line, the second side outlet check valve oriented to block flow from the second side connection line toward the TXV outlet line;

wherein the bypass inlet connects to the TXV inlet line downstream of the first and second side inlet lines and the bypass outlet connects to the TXV outlet line upstream of the first and second side outlet lines.

2. The SSCC of claim 1, wherein the bypass line includes a flow restricting orifice.

3. The SSCC of claim 1, further comprising a filter dryer arranged in the TXV inlet line upstream of the bypass inlet.

4. The SSCC of claim 1, further comprising a liquid receiver arranged in the TXV inlet line upstream of the bypass inlet.

5. The SSCC of claim 1, further comprising:

a filter dryer arranged in the TXV inlet line upstream of the bypass inlet; and a liquid receiver arranged in the TXV inlet line upstream of the bypass inlet.

6. The SSCC of claim 5, wherein the filter dryer is upstream of the liquid receiver.

7. The SSCC of claim 1, further comprising a sensing line connected to the sensing connection.

8. The SSCC of claim 7, wherein the sensing line includes a capillary tube connected to the sensing connection and a sensing bulb at a distal end of the capillary tube, the sensing line including a sensing line refrigerant sealed therein.

9. The SSCC of claim 1, wherein further comprising an external equalization line connected to the equalization connection.

10. The SSCC of claim 1, further comprising:

a filter dryer arranged in the TXV inlet line upstream of the bypass inlet and downstream of the first and second side inlet lines; and a liquid receiver arranged in the TXV inlet line upstream of the bypass inlet and downstream of the filter dryer.

11. A method of reducing condenser subcooling and evaporator superheating in a heat pump system using the SSCC of claim 1, the method comprising:

passing refrigerant flow from a condenser outlet to the suction stabilizer control circuit (SSCC);

dividing the refrigerant flow in the SSCC into first and second portions;

directing the first portion of the refrigerant flow in the SSCC to the TXV;

variably throttling the first portion of the refrigerant flow in the TXV based on sensed superheating at an evaporator outlet;

directing the second portion of the refrigerant flow in the SSCC to the bypass line bypassing the TXV; and combining the first and second portions of the refrigerant flow downstream of the TXV and supplying the combined refrigerant flow to an evaporator inlet.

12. The method of claim 11, wherein directing the second portion of the refrigerant flow in the SSCC to the bypass line bypassing the TXV including passing the second portion of the refrigerant flow through a flow restricting orifice in the bypass line.

13. The method of claim 11, further comprising passing the refrigerant flow from the condenser outlet through a filter dryer before dividing the refrigerant flow into first and second portions.

14. The method of claim 11, further comprising passing the refrigerant flow from the condenser outlet through a liquid receiver before dividing the refrigerant flow into first and second portions.

15. The method of claim 11, further comprising passing the refrigerant flow from the condenser outlet through a filter dryer and a liquid receiver before dividing the refrigerant flow into first and second portions.

16. The method of claim 15, wherein the refrigerant flow is passed through the filter dryer before the liquid receiver.

17. A heat pump system comprising:

an evaporator having an evaporator inlet and outlet;

a condenser having a condenser inlet and outlet;

a refrigerant vapor transport line extending between the evaporator outlet and the condenser inlet;

a compressor arranged in the refrigerant vapor transport line between a compressor inlet and outlet and operable to compress the refrigerant vapor passing therethrough;

a refrigerant liquid transport line extending between the condenser outlet and the evaporator inlet; and a suction stabilizer control circuit (SSCC) arranged in the refrigerant liquid transport line, the SSCC including:

a thermostatic expansion valve (TXV) including a valve body defining a valve flow path extending between a TXV inlet and TXV outlet, the valve body including a TXV head portion having a sensing connection and an equalization connection;

a throttling element extending into the valve flow path and movable to variably restrict refrigerant flow passing from the TXV inlet to the TXV outlet;

a diaphragm positioned in the TXV head portion and connected to the throttling element such that increased pressure from the sensing connection will urge the throttling element to increase refrigerant flow restriction; and a biasing element arranged in the valve body operable to urge the throttling element to decrease refrigerant flow restriction;

TXV inlet and outlet lines extending from the TXV inlet and the TXV outlet, respectively, and connected in the refrigerant liquid transport line;

a TXV bypass line having a bypass inlet and a bypass outlet connected to the TXV inlet line and TXV outlet line, respectively, such that a predetermined portion of refrigerant flow passing through the refrigerant liquid transport line between the TXV inlet and outlet lines passes through the TXV bypass line; and a sensing line extending from the sensing connection to a distal end in thermal contact with the refrigerant vapor transport line proximate the evaporator outlet;

first and second side connection lines for connecting in a liquid refrigerant transport line between heat exchangers of the heat pump system;

first side inlet and outlet lines branching from the first side connection line and connected with the TXV inlet line and TXV outlet line, respectively;

first side inlet and outlet check valves arranged in the first side inlet and outlet lines, respectively, the first side inlet check valve oriented to block flow from the TXV inlet line toward the first side connection line, the first side outlet check valve oriented to block flow from the first side connection line toward the TXV outlet line; and second side inlet and outlet check valves arranged in the second side inlet and outlet lines, respectively, the second side inlet check valve oriented to block flow from the TXV inlet line toward the second side connection line, the second side outlet check valve oriented to block flow from the second side connection line toward the TXV outlet line;

wherein the bypass inlet connects to the TXV inlet line downstream of the first and second side inlet lines and the bypass outlet connects to the TXV outlet line upstream of the first and second side outlet lines.

18. The heat pump system of claim 17, wherein the bypass line including a flow restricting orifice.

19. The heat pump system of claim 17, wherein the SSCC further includes:

a filter dryer arranged in the TXV inlet line upstream of the bypass inlet; and a liquid receiver arranged in the TXV inlet line upstream of the bypass inlet.

* * * * *